US006039274A

United States Patent [19]

Zinoviev et al.

[11] Patent Number: 6,039,274

[45] Date of Patent: Mar. 21, 2000

[54] METHOD AND APPARATUS FOR CRUSHING NONCONDUCTIVE MATERIALS

[75] Inventors: Nikolai Timofeevich Zinoviev; Boris Vasilievich Siomkin, both of Tomsk, Russian Federation

[73] Assignee: Itac, Ltd., Niigata, Japan

[21] Appl. No.: 08/913,087

[22] PCT Filed: Feb. 21, 1996

[86] PCT No.: PCT/JP96/00392

§ 371 Date: Oct. 20, 1997

§ 102(e) Date: Oct. 20, 1997

[87] PCT Pub. No.: WO96/26010

PCT Pub. Date: Aug. 29, 1996

[30] Foreign Application Priority Data

Feb. 22, 1995 [RU] Russian Federation ..... 95102571

[51] Int. Cl.[7] ..... B02C 19/00

[52] U.S. Cl. ..... 241/1; 241/24.12; 241/24.13; 241/29; 241/46.01; 241/152.1

[58] Field of Search ..... 241/1, 5, 24.11, 241/24.12, 30, 46.01, 301, 24.13, 29, 152.1

[56] References Cited

U.S. PATENT DOCUMENTS

| | | | |
|---|---|---|---|
| 2,661,784 | 12/1953 | McMillan | 146/227 |
| 2,796,673 | 7/1957 | Kunz et al. | 241/1 |
| 3,749,958 | 7/1973 | Ward | 313/146 |
| 3,895,760 | 7/1975 | Snyder | 241/5 |
| 3,912,174 | 10/1975 | Karpinski et al. | 241/24 |
| 4,313,573 | 2/1982 | Goldberger et al. | 241/1 |
| 4,324,367 | 4/1982 | Bowling et al. | 241/60 |
| 4,540,127 | 9/1985 | Andres | 241/1 |
| 4,653,697 | 3/1987 | Codina | 241/1 |
| 5,699,969 | 12/1997 | Isaji | 241/24 |

FOREIGN PATENT DOCUMENTS

| | | | |
|---|---|---|---|
| S46-26574 | 8/1971 | Japan . | |
| S62-502733 | 10/1987 | Japan . | |
| 0386676 | 9/1989 | U.S.S.R. | 241/1 |

*Primary Examiner*—Joseph J. Hail, III
*Attorney, Agent, or Firm*—Koda & Androlia

[57] ABSTRACT

A method of crushing or smashing nonconductive materials such as natural ore materials and concretes by a discharge voltage requires a large amount of energy for crushing or smashing. Products produced by crushing or smashing have not been recycled effectively as new nonconductive raw materials. A value set by the quality and a thickness of the nonconductive materials to be crushed, an impulse voltage Uo, a time constant $\tau$ and a spark constant A is defined as a parameter P of an electric circuit. By setting the value of P to $0.02 \leqq P \leqq 1.0$ to cause crushing, energy stored in the circuit can be utilized effectively. Accordingly, uniform-crushedor smashed matter with high quality can be manufactured effectively.

5 Claims, 4 Drawing Sheets

METHOD AND APPARATUS FOR CRUSHING NONCONDUCTIVE MATERIALS

TECHNICAL FIELD

The present invention relates to a method and an apparatus for crushing or smashing nonconductive materials containing conductive materials such as natural nonconductive ore materials such as quartzites, granites, rocks and the like or waste ferro-concretes or resin molded products containing metal reinforcements to be able to be recycled as new raw nonconductive materials.

BACKGROUND TECHNIQUE

A method of processing nonconductive materials such as ferro-concretes containing conductive materials such as reinforcements and recycling the processed materials to manufacture new nonconductive materials is known as described in A. F. Usov, B. V. Siomkin and N. T. Zinovyev, "TRANSITIONAL PROCESSES IN THE PLANTS USING IMPULSE TECHNOLOGIES" (Leningrad: Nauka, 1987), page 189. In this method, waste ferro-concretes are placed in the water, are crushed by electric discharge and further smashed to pieces. Ferro reinforcements are removed from the smashed waste ferro-concretes, and water containing the smashed pieces of concrete, which was used in crushing or smashing of nonconductive materials, is removed by a pump. New ferro-concretes are manufactured using the pieces as raw materials.

In the above method, however, a very large amount of energy is required to crush the ferro-concretes. As a result, all of the ferro-concretes are no crushed and recycled, so that the amount of recycled ferro-concretes is reduced.

The above defect is partially solved by the method described in page 96 of "RECYCLING OF CONCRETES" (Moscow, Stroyiztat, 1988) by B. V. Gusev and V. A. Zagurskiy. According to this method, waste ferro-concretes are preliminarily crushed by a crushing machine and ferro reinforcements are then removed from the crushed waste ferro-concretes and melted. After the crushed concrete is further smashed to pieces, the crushed concrete is classified by size and kind of pieces. The classified pieces of concrete are mixed to manufacture a new mixture of concrete.

In the above method, however, the optimum amount of the electro impulse and electric-physical properties of crushed concrete is not considered. Accordingly, there is the problem that a voltage required for crushing of concrete cannot be adjusted, so that concretes cannot be crushed with an efficient use of energy. Further, all of the processed products such as crushed and smashed concrete materials and ferro reinforcements cannot be recycled as raw materials of new concrete and the problem that the amount of recycled waste ferro-concretes is low is not solved.

It is an object of the present invention to solve the above problems in the prior art by providing a method or an apparatus for crushing or smashing nonconductive materials such as waste ferro-concretes with reduced consumption of energy and capable of recycling almost all of the crushed or smashed non-conductive materials to produce new nonconductive raw materials.

DISCLOSURE OF THE INVENTION

According to the present invention, in the method of crushing or smashing nonconductive materials by electric discharge impulse, when a parameter of an electric circuit for applying a discharge voltage is defined as P, electric discharge is made when a value of the parameter P is within a range of $0.02 \leqq P \leqq 1.0$.

The parameter P is expressed by the following equation 1, where l represents a thickness of nonconductive materials, Uo a impulse voltage applied to the nonconductive materials, and $\tau$ a time constant. Further, A represents a spark constant, which is proportional to a sum total of currents flowing when the impulse voltage is applied to the nonconductive materials and a resistance value and is inversely proportional to the thickness l.

$$P = \frac{Al}{U_0 \tau^{1/2}} \quad \text{(Equation 1)}$$

The nonconductive materials may contain conductive materials. In this case, the conductive materials function as ground and when the nonconductive materials are crushed or smashed, the conductive materials can be taken out while they maintain their original shape or quality.

The nonconductive materials of the present invention includes natural ore materials, concretes, resin products, rubber products and the like. Further, the conductive materials include ferro reinforcements or carbon fibers contained in the concretes, metal fillers contained in the resin products, metal materials contained in the rubber products and the like.

Further, nonconductive materials are put into a container filled with liquid and a high-voltage electrode for applying a voltage abuts against the nonconductive materials to thereby apply electric discharge to the nonconductive materials while using the liquid or container as ground.

According to the present invention, in the crushing apparatus of nonconductive materials including an installation member of the nonconductive materials, high-voltage electrodes for applying a high voltage to the nonconductive materials, and an electric circuit for applying a discharge voltage to the high-voltage electrodes, when a parameter of the electric circuit for supplying a discharge voltage is defined as P, electric discharge is made within a range of $0.02 \leqq P \leqq 1.0$;

The parameter P is expressed by the equation 1, where l represents a thickness of each of the nonconductive materials, Uo a impulse voltage applied to nonconductive materials, and $\tau$ a time constant. Further, "A" represents a spark constant, which is proportional to a sum total of currents flowing when the impulse voltage is applied to the nonconductive materials and a resistance value and is inversely proportional to the thickness l.

With the above structure, nonconductive materials containing conductive materials can be crushed or smashed.

Further, nonconductive materials are put in a container filled with liquid and the high-voltage electrode for applying a voltage can abut against the nonconductive materials to give electric discharge to the nonconductive materials using the liquid or container as ground.

The container can be structured to includes a bottom plate having a porous structure through which crushed or smashed nonconductive materials can drop and an opening and closing gate for taking out the materials dropped from the bottom plate, to thereby separate conductive materials from crushed or smashed nonconductive materials.

In addition, a plurality of the containers are arranged in a cascade manner and nonconductive materials crushed in a first container are successively moved into a container at a next-stage for crushing or smashing again, so that nonconductive materials can be crushed completely.

For example, as shown in FIG. 2, the electric circuit for applying the discharge voltage desirably comprises a series/parallel conversion circuit of condensers, generation members for generating a high-voltage, impulse generator comprising discharge spheres or discharge electrodes disposed opposite to each other separate from each other by a predetermined distance, a plurality of condensers connected in parallel to one another before discharge occurs in the discharge spheres or discharge electrodes and connected in series to one another when discharge occurs in the discharge spheres or discharge electrodes, and inductance elements connecting between the condensers when the condensers are connected in parallel to one another.

BEST MODE FOR CARRYING OUT THE INVENTION

Before explaining an embodiment of the present invention, a parameter P of an electric circuit defined by the Inventors in the present invention is now described.

P is a parameter of an electric circuit for supplying discharge energy for crushing or smashing nonconductive materials represented by concrete in the present invention and is the number of no dimension expressed by the equation 1.

In the equation 1, "A" represents a spark constant defined by the Inventor and related when electric impulse is applied to nonconductive materials such as concrete. "l" represents a thickness in meters of each of the nonconductive materials such as, for example, concretes, "Uo" represents a impulse voltage in kV (kilovolt) of the electric circuit and "τ" represents a time constant in s (second) in the electric circuit.

Figure 2:
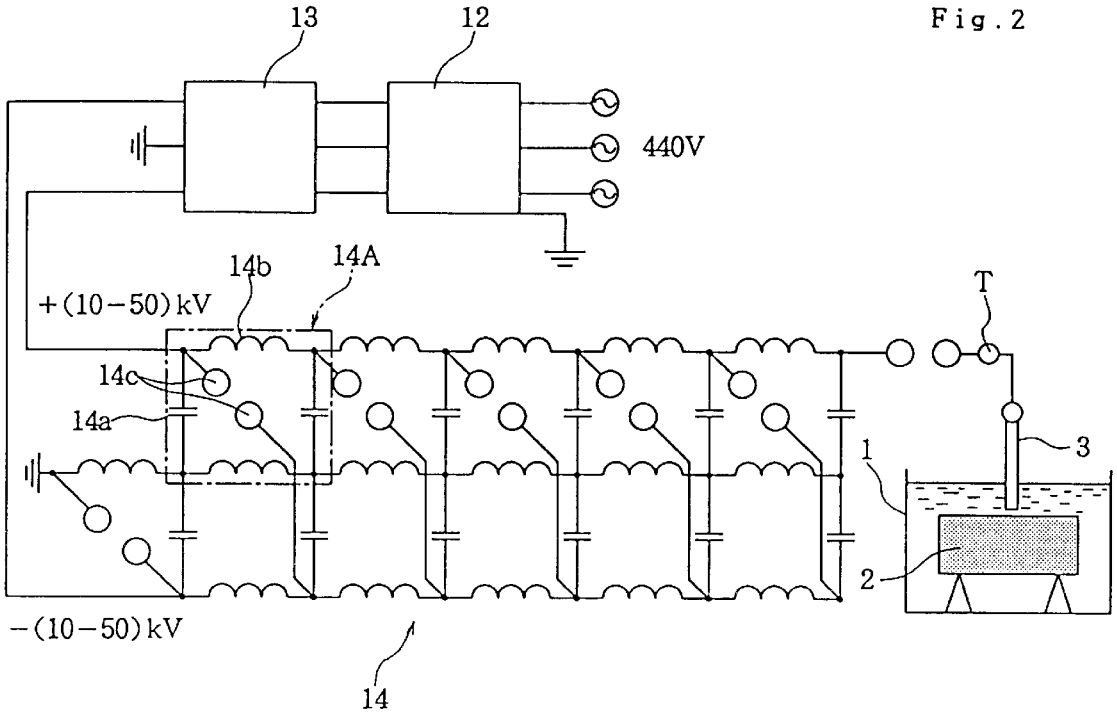
FIG. 2 is a circuit diagram of an electric circuit for supplying discharge energy to high-voltage electrodes for crushing or smashing nonconductive materials in the present invention.
Figure 3:
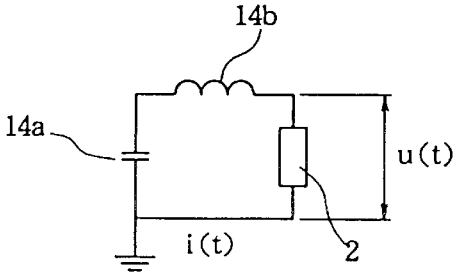
FIG. 3 is an equivalent circuit diagram of the circuit shown in FIG. 2.

The time constant τ is determined by an inductance and a capacitance of the whole circuit shown in FIGS. 2 and 3 and is expressedby the following equation.

(Equation 2)

$$\tau=\sqrt{\sqrt{LC}}$$

In the equation 2, L represents an inductance in H (henry) of the whole circuit, and C represents a capacitance in F (farad) in the circuit.

In the equation 1, "A" represents an integral constant named as a spark constant. When a current i (ampere) flows in nonconductive materials having a thickness of l (m) in response to a fixed high voltage Uo (V) in a short time t (second) and an electric resistance of each of the nonconductive materials is R (ohm), the relation shown by the following equation 3 is effected among them.

(Equation 3)

$$R=Al\left(\int_0^t i^2 dt\right)^{-1/2}$$

"A" functions as a constant for equalizing the left side to the right side of the equation 3 and is expressed by the dimension of unit ($V\cdot sec^{1/2}\cdot m^{-1}$) from the relation of the left side and the right side of the equation 3. In the present invention, the constant A expressed by this dimension is named the spark constant. Further, the constant A can be expressed by the following equation 4 from the equation 3.

$$A=\frac{R}{l}\left(\int_0^t i^2 dt\right)^{1/2} \quad \text{(Equation 4)}$$

The equations 3 and 4 can be understood easily by comparing the equations with the Ohm's law (R=voltage/current). In the present invention, nonconductive materials such as concretes are crushed or smashed by electric discharge impulse, while when a discharge voltage is applied to the nonconductive materials actually, an electrical resistance value of concretes or the like cannot be expressed quantitatively. Thus, when a discharge voltage is applied to concrete having a thickness of l, an integrated value of variation of a current flowing in a short time t by time is defined as a current value flowing through concrete having the thickness of l and a product of the integration constant A and l is replaced by a voltage in the Ohm's law.

Accordingly, by applying a high-voltage pulse to nonconductive materials such as concretes actually to measure a current i flowing through the electrode and calculating a resistance R of each of the nonconductive materials from a capacitance and an inductance in the circuit applied with a discharge voltage, the voltage and the current i, the spark constant A can be obtained experimentally from the current, the resistance R and the thickness l each of the nonconductive materials. The spark constant A is an inherent value in accordance with each of the nonconductive materials. Further, a spark constant A of, for example, waste ferro-concretes or resin molded product containing metal fillers or rubber products containing metal materials has an inherent value in accordance with a combination of conductive materials such as reinforcing rods, metal fillers or metal materials and nonconductive materials such as concretes, resins and rubbers (considering a mixed ratio thereof).

In the present invention, when nonconductive materials such as concretes are crushed or smashed by electric discharge impulse, circuit values such as a impulse voltage Uo applied from the electric circuit shown in FIG. 2 and the like, an inductance L and a capacitance C are varied or are selected to be proper values in accordance with a value of the resistance R of each of the nonconductive materials calculated by the equation 3 to thereby crush or smash the nonconductive materials with effective energy. The parameter P is set with the relation of the resistance R, the thickness l, the spark constant A and the time constant τ, and a range of the parameter P that nonconductive materials can be crushed or smashed with most effective energy use is to be calculated.

More particularly, the parameter P which is a constant of no dimension is set to examine the interrelation of the spark constant A, the thickness l of each of the nonconductive materials, the impulse voltage Uo and the time constant τ (inductance L and capacitance C) in the whole circuit by an experiment and vary them. Attention is paid to the fact that circumstances upon crushing or smashing of nonconductive materials can be set to be identical when a value of P is the same even if values of the variables A, l, Uo, τ (L, C) are varied.

For example, it is first assumed that the parameter of the circuit is $P_1$ when the variables are $A_1$, $l_1$, $Uo_1$ and $\tau_1$ ($L_1$ and $C_1$) and the parameter is $P_2$ when the variables are $A_2$, $l_2$, $Uo_2$ and $\tau_2$ ($L_2$ and $C_2$). At the time when $P_1=P_2$, the crushing conditions are identical.

When nonconductive materials such as, for example, ferro-concretes are crushed or smashed by electric discharge impulse, it is desirable to change the impulse voltage Uo, the inductance L and the capacitance C in accordance with a value of the resistance R of the ferro-concretes to change a value of the parameter P in order to crush or smash the ferro-concretes effectively. In the present invention, by setting a value of P upon crushing of nonconductive materials to $0.2 \leqq P \leqq 1.0$, energy stored in the electric circuit is utilized effectively to crush nonconductive materials.

Figure 1:
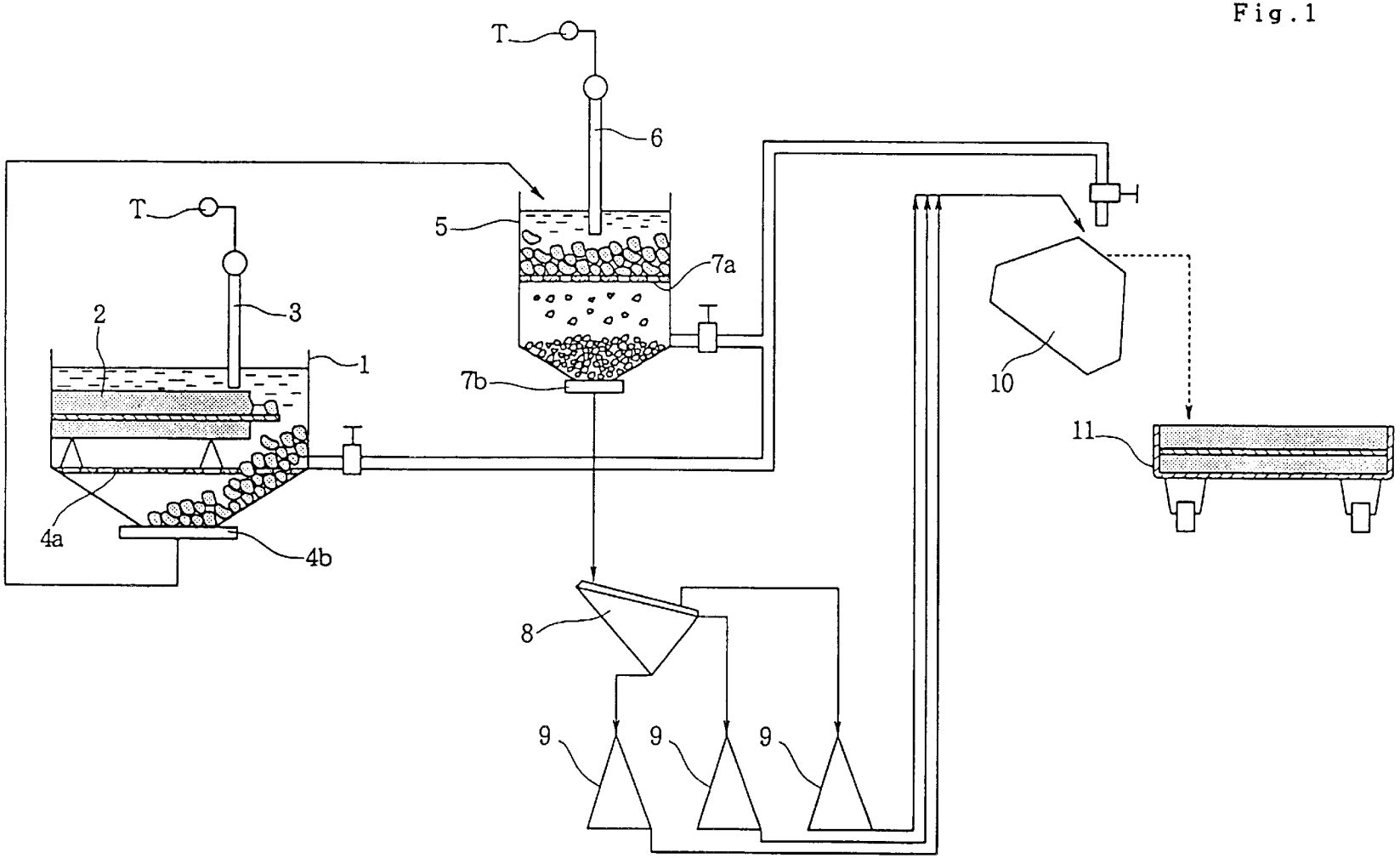
FIG. 1 is a schematic diagram illustrating a crushing method and apparatus of non-conductive materials and a recycling and manufacturing apparatus of crushed materials according to the present invention.

A structure of the present invention is now described with reference to the accompanying drawings. FIG. 1 illustrates a crushing method and apparatus of nonconductive materials and a recycling and manufacturing apparatus of crushed materials according to the present invention.

In FIG. 1, numeral 1 denotes a first container and numeral 2 denotes waste ferro-concrete, for example, as nonconductive material, and in the embodiment the waste ferro-concrete 2 is matter to be crushed by electric discharge impulse. Numeral 3 denotes a first high-voltage electrode, 4*a* a bottom plate having a porous structure, 4*b* an opening and closing gate, 5 a second container, 6 a second high-voltage electrode, 7*a* a bottom plate having a porous structure, 7*b* an opening and closing gate, 8 a classifying apparatus, 9 filler storage apparatuses, 10 a mixing apparatus for concrete, and 11 a pouring mold. In the embodiment shown in FIG. 1, two high-voltage electrodes are provided, although crushing or smashing may be made by only one high-voltage electrode. Further, three or more high-voltage electrodes may be used to crush or smash nonconductive materials.

The above apparatus is used as follows. The waste ferro-concrete 2 constituting the matter to be crushed is put into the first container 1 filled with water and the first high-voltage electrode 3 is disposed above the ferro-concrete. The first and second high-voltage electrodes 3 and 6 are connected to the circuit shown in FIG. 2 through a terminal T and a high-voltage impulse is supplied thereto from the electric circuit. Ferro reinforcements contained in the waste ferro-concrete 2, the first container and water in the first container are utilized as ground. Impulse force by electric discharge is applied to the waste ferro-concrete 2 from the first high-voltage electrode 3 to thereby crush the waste ferro-concrete 2. After the waste ferro-concrete 2 is crushed, ferro reinforcements are exposed. The ferro reinforcements are recycled as materials for newly manufactured ferro-concrete. The bottom plate 4*a* of the porous structure is moved vertically or horizontally to thereby drop crushed or smashed pieces of concrete into a lower chamber so that the pieces are separated from the ferro reinforcement. The crushed pieces of concrete are removed from the opening and closing gate 4*b* and water containing the pieces is removed. Then, the crushed pieces are conveyed to the second container 5. The conveyance of the crushed pieces of concrete from the first container 1 to the second container 5 may be made by a belt conveyer, for example.

Water is put into the second container 5 and the crushed pieces of concrete are finely smashed by electric impulse force from the second high-voltage electrode 6. The finely smashed concrete pieces are dropped through the bottom plate 7*a* of the porous structure and are taken out from the opening and closing gate 7*b*. The removed concrete pieces are classified minutely by the classifying apparatus 8 and are then put into the filler storage apparatuses 9.

Water exhausted from the first and second containers 1 and 5 is fed into the mixing apparatus 10. Further, crushed pieces of concrete in the second container 5 are also fed from the filler storage apparatus 9 to the mixing apparatus 10. Adequate volume of concrete and water having the proper composition are mixed in the mixing apparatus 10 to produce concrete mixture. Then, the concrete mixture and the ferro reinforcements taken out by the crushing of the waste ferro-concrete 2 are put into the pouring mold 11 to manufacture new ferro-concrete. When the concrete mixture is manufactured, unused filler can be added to the concrete powder obtained from the waste ferro-concrete 2 to thereby manufacture ferro-concrete of good quality.

FIG. 2 is a schematic diagram illustrating the electric circuit for supplying a impulse voltage to the first and second high-voltage electrodes 3 and 6.

As shown in FIG. 2, the first high-voltage electrode 3 is connected to the electric circuit through a terminal T. Although not shown, the second high-voltage electrode is also connected to the electric circuit in the same manner. The electric circuit shown in FIG. 2 includes a voltage regulator 12, a high-voltage transformer 13 and a impulse generator 14. The impulse generator 14 includes circuits 14A . . . , which are connected in parallel to one another, and each of the circuits 14A includes condensers 14*a*, inductances 14*b* and discharge spheres (or discharge electrodes) 14*c*.

Operation of the electric circuit shown in FIG. 2 is now described. First, a voltage is applied to the voltage regulator 12 and the voltage is transformed to a high voltage by the high-voltage transformer 13. When a voltage, of, for example, 440 V is applied to the voltage regulator 12, the voltage is transformed to a high voltage of (10–50) kV by the high-voltage transformer 13. The representation (10–50) means "greater than or equal to 10 and less than or equal to 50" and hereinafter the same representation is used with the same meaning.

The voltage transformed by the high-voltage transformer 13 is supplied to the circuits 14A . . . and energy is stored in the condensers 14*a* . . . . At this time, since the circuits 14A, . . . are not connected by the discharge spheres 14*c*, the condensers 14*a* . . . are connected in parallel and the same electric charges are applied to all of the condensers 14*a* . . . . When high energy is stored in the condensers 14*a* . . . and a predetermined voltage is reached, discharge occurs between the adjacent discharge spheres 14*c* and 14*c* and resistances of the circuits 14A . . . are reduced to 0, so that the circuits 14A . . . , that is, the condensers are connected in series.

The voltage at this time depends on a distance between the discharge spheres 14*c* and the distance can be adjusted to thereby set the voltage to a predetermined electric charge value. The impulse voltage Uo is applied to the first and second high-voltage electrodes 3 and 6 from the series connected impulse generators 14, so that discharge occurs in the waste ferro-concrete 2. The energy W (Joule) stored in the impulse generator 14 can be expressed by the following equation 5.

$$W = \frac{CUo^2}{2} \quad \text{(Equation 5)}$$

Further, representative electric power No (watt) stored in the electric circuit can be expressed by the following equation 6 by dividing the energy W by a time constant τ.

$$No = \frac{W}{\tau} = \frac{CUo^2}{2\tau} \quad \text{(Equation 6)}$$

Figure 4:
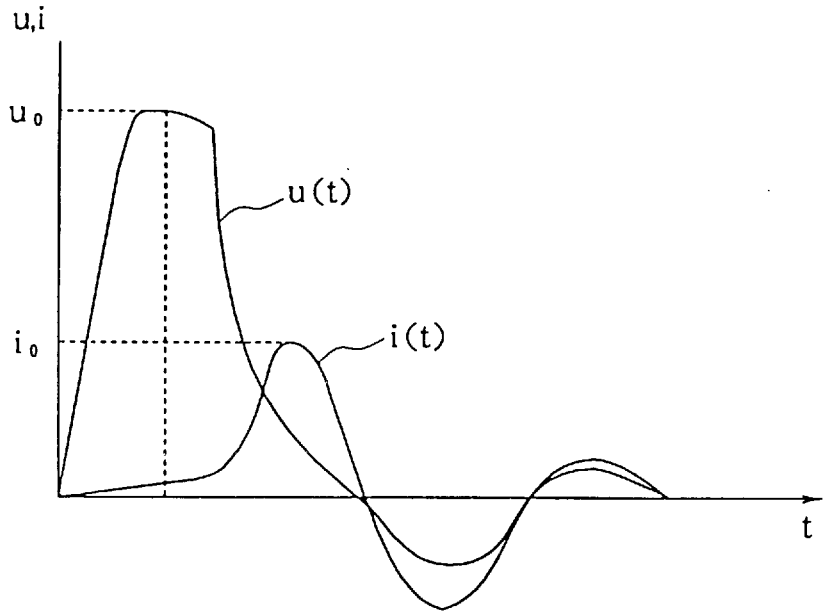
FIG. 4 is a graph showing the relation of electric power u(t) and i(t) and time t in the equivalent circuit shown in FIG. 3.

FIG. 3 is an equivalent circuit diagram of the whole circuit containing the impulse generator 14 shown in FIG. 2 and the waste ferro-concrete 2 constituting the matter to be crushed. When a voltage of the circuit is u(t) and a current flowing in the circuit is i(t), the relation by the time of the voltage u(t) and the current i(t) with respect to time t is shown in FIG. 4. The equivalent circuit is represented by a general RCL circuit and resistance R is a resistance component of the waste ferro-concrete 2. The resistance R is to be defined by the equation 3.

Further, electric power N(t) (consumption power in case of the resistance is R) where the circuit at time t can be represented by a product of the voltage u(t) and the current i(t) as shown in the following equation 7.

(Equation 7)

$$N(t)=i(t)\times u(t)$$

In the present invention, the value of the parameter P of the electric circuit has been set as a result that the crushing apparatus of nonconductive materials of the present invention shown in FIGS. 1 and 2 was used to perform an actual process by means of a processing method described below.

As the nonconductive materials, concretes of the Russian Gost standard 200, 300, 400 and 500, quartzite and granite were used. The spark constants A of the concrete, the quartzite and the granite are shown in Table 1.

TABLE 1

| | Russian Gost Standard of Concrete | | | | | Granite | quartzite |
|---|---|---|---|---|---|---|---|
| | 200 | 300 | 400 | 500 | 600 | | |
| A, ($V_s^{1/2}m^{-m}$) | 290 | 305 | 325 | 350 | 375 | 600 | 800 |

The spark constant A of each concretes in Table 1 can be calculated from the equation 4 by applying the high impulse voltage Uo to concrete materials having a predetermined thickness l, calculating a current flowing in the electrode applied with the impulse voltage Uo and calculating the resistance R of concrete in consideration of the impulse voltage Uo, the current, the capacitance C and the inductance L of the circuit for applying the impulse voltage Uo.

The ranges of values Uo, C and L of the electric circuit used when the matter to be crushed such as the concrete and natural rock is crushed are shown below.

Uo=(120–600) kV

C=(0.016–0.225) μF

L=(10–830) μH

τ=(0.4–13.6) μS

These values can be varied to set the parameter P to a value suitable for crushing of material having not only different Gost or spark constant A but also different thicknesses l.

FIG. 4 shows variation of the current i(t) and the voltage u(t) with respect to time t of the equivalent circuit shown in FIG. 3. FIG. 4 shows that there is a time difference between the time that the current i(t) is a maximum value $i_o$ and the time that the voltage u(t) is a maximum value $u_o$ when the impulse voltage Uo is applied to nonconductive material, for example, concrete.

Figure 5:
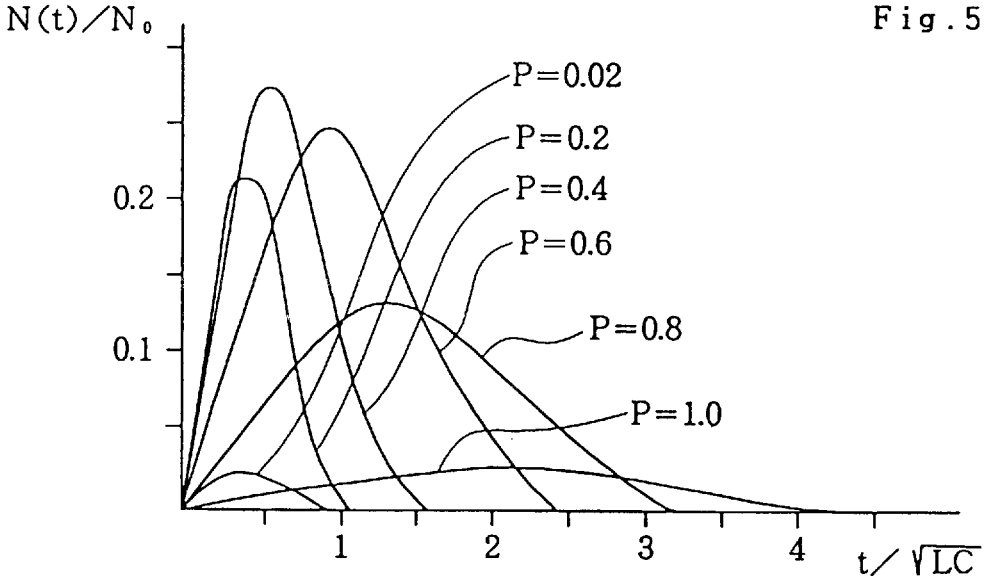
FIG. 5 is a graph showing the relation of the numbers $t/(LC)^{1/2}$ and N(t)/No of no dimension in the time system with respect to different values of P.

FIG. 5 is a graph showing the relation of $t/(LC)^{1/2}$ and N(t)/No with respect to each value of the parameters P of the electric circuit which are set to 0.02, 0.2, 0.4, 0.6, 0.8 and 1.0 when the matters to be crushed shown in Table 1 are crushed or smashed. The abscissa represents $t/(LC)^{1/2}$, that is, the number of no dimension in the time system and the ordinate represents N(t)/No, that is, electric power consumed in the resistance R to electric power stored in the electric circuit. The increased N(t)/No means that electric power consumed in the first or second high-voltage electrode 3 or 6 is increased and force for crushing or smashing concrete and the natural rock is large.

When P=0.02 and P=1.0, the maximum value of N(t)/No does not reach 0.1. On the contrary, when P=0.4, the maximum value of N(t)/No is maximum, which is N(t)/No=0.275 at $t/(LC)^{1/2}$=1.5. When the value of P exceeds 1, the time required for discharge is made long and the conductive efficiency is remarkably reduced. When the values of Uo, C, L and T relative to the electric circuit are such that the value of P is within the above ranges, the crushing phenomenon does not occur. When P is less than 0.02, the discharge time is extremely short and the efficiency of electric power is also remarkably reduced in this case. When the values relative to the electric circuit are such that the value of P is within the above ranges, crushing does not occur. The efficiency of energy use is maximum when P=0.4.

Figure 6:
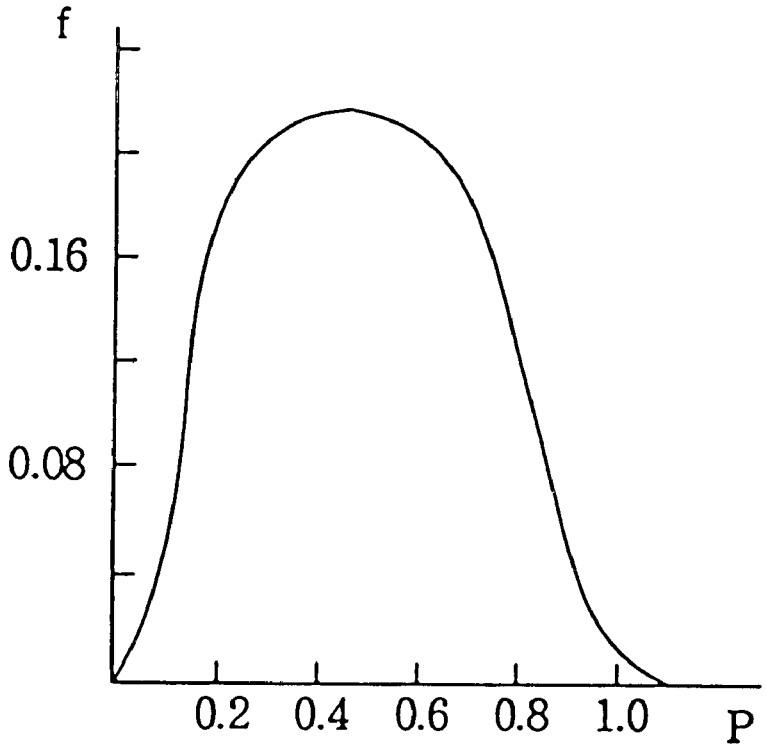
FIG. 6 is a graph showing the relation of P and a maximum value f of N(t)/No.

FIG. 6 is a graph showing the relation of the parameter P and a maximum value $f=N_{max}/No$ of N (t) /No from the graph shown in FIG. 5.

$N_{max}$ is the maximum value of N(t) and f is maximum when $N_{max}$=No. That is, the maximum value of f is f=1. When the value of f is large, electric power consumed in the first high-voltage electrode 3 is increased and the crushing energy for nonconductive material such as concrete and natural ore material is large.

In FIG. 6, when P is smaller than or equal to 0.02 or larger than or equal to 1.0, f is a value substantially close to 0. That is, when P is smaller than or equal to 0.02 or larger than or equal to 1.0, $N_{max}$ is very small as compared with No and energy consumed to crush concrete is small. Accordingly, when P is smaller than or equal to 0.02 or larger than or equal to 1.0, matters to be crushed are not crushed. Further, when P is $0.02 \leqq P \leqq 1.0$, the value of f is larger than or equal to 0 and when P=0.4 the value of f is maximum. Accordingly, in the present invention, the value of P upon crushing of concrete is $0.02 \leqq P \leqq 1$ and desirably P=0.4.

Next, differently from the experiment, the energy efficiency $\eta_1$ in the case where the crushing method of the present invention is used was calculated from the equation described below. The following equations 8 to 10 are defined by the inventions of the present invention.

The equation for calculating the energy efficiency $\eta_1$ is the following equation 8.

(Equation 8)

$$\eta_1=2.82\times P\times y_{max}\times \tau_1^{1/2}$$

$y_{max}$ of the equation 8 is calculated by the following equation 9.

$$y_{max} = \begin{cases} 1.5(0.67 - P) & P \leqq 0.4 \\ 0.67(1 - P) & 0.4 < P \leqq 0.75 \end{cases} \quad \text{(Equation 9)}$$

Further, $\tau_1$ of the equation 8 is calculated by the following equation 10.

$$\tau_1 = \begin{cases} 1 + 1.35P & P \leqq 0.4 \\ 7.02P - 1.27 & 0.4 < P \leqq 0.75 \end{cases} \quad \text{(Equation 10)}$$

As described above, the energy efficiency $\eta_1$ depends on the value of the parameter P of the electric circuit.

For example, when P=0.4, the energy efficiency $\eta_1$ is calculated to be 56.7% by the above equations 8, 9 and 10. Accordingly, when P=0.4, concrete is crushed while the energy (electric power) stored in the circuit is reduced by 56.7%.

Next, the energy efficiency $\eta_1$ in the case where concrete of the Gost standard 200 and having a thickness of 0.1 m was crushed on condition of Uo=357 kV, C=0.09 $\mu$F and L=150 $\mu$H was calculated. Since the spark constant A of the concrete of the Gost standard 200 is 290 $V \cdot s^{1/2} \cdot m^{-1}$ from Table 1, the parameter P is P=0.0419 from the equation 1. Accordingly, the energy efficiency at this time is 11.4% from the equations 8, 9 and 10. In other words, concrete can be crushed while electric power stored in the electric circuit shown in FIG. 2 is reduced by 11.4%, while the energy efficiency $\eta_1$ at this time is smaller than that for P=0.4.

Further, a thickness of concrete of the Gost standard 200 is set to 0.01 m and the concrete was crushed on the same condition of the electric circuit. The parameter P of the electric circuit at this time is 0.0042. The energy efficiency is calculated as 1.2% by the equations 8, 9 and 10 and it is understood that the energy efficiency is deteriorated. These values are very near values to experimental values.

INDUSTRIAL AVAILABILITY

According to the present invention described above in detail, when nonconductive materials such as natural ore materials, concretes, resin or rubber are crushed or smashed by discharge voltage, the parameter of the electric circuit for supplying the discharge voltage is defined as P and the value of P can be set to the reference to thereby utilize electric power stored in the electric circuit effectively.

Further, when conductive reinforcements are contained in nonconductive materials, the reinforcements function as ground and only the nonconductive materials are crushed or smashed. Accordingly, the conductive reinforcements can be taken out while being contained therein.

In addition, since almost all of processed matters produced by crushing or smashing can be recycled in accordance with a purpose, new nonconductive materials can be produced in accordance with the object of the present invention inexpensively without production of waste matters.

We claim:

1. A method for crushing or smashing nonconductive materials by electric discharge impulse, comprising;

setting parameters of an electric discharge circuit for supplying a discharge voltage to nonconductive materials such that P as expressed by the following equation is within a range of $0.02 \leqq P \leqq 1.0$;

$$P = \frac{Al}{U_0 \tau^{1/2}}$$

where said parameters of said electric discharge circuit comprise l which is a thickness of said nonconductive materials, $U_0$ an impulse voltage applied to said nonconductive materials, $\tau$ which is a time constant, and A which is a spark constant which is proportional to a sum total of currents flowing when said impulse voltage is applied to said nonconducive materials and a resistance and is inversely proportional to said thickness l; and applying said electric discharge impulse from said electric discharge circuit to said nonconductive materials.

2. A crushing method for nonconductive materials according to claim 1, wherein conductive materials are mixed in with said nonconductive materials.

3. A crushing method for nonconductive materials according to claim 1 or 2, further comprising putting said nonconductive materials (2) in a container (1), (5), filling said container (1), (5) with liquid and placing high-voltage electrodes (3), (6) in contact with said nonconductive materials for applying said electric discharge impulse to said nonconductive materials (2) to produce electric discharge while using said liquid or container (1), (5) as ground.

4. A crushing apparatus for nonconductive materials comprising a container for nonconductive materials, high-voltage electrodes (3), (6) for applying a high voltage to said nonconductive materials abutting against said nonconductive materials, and an electric circuit for applying a discharge voltage to said high-voltage electrodes (3), (6), wherein when a parameter of said electric circuit for applying said discharge voltage is defined as P expressed by the following equation, electric discharge is made within a range of $0.02 \leqq P \leqq 1.0$;

$$P = \frac{Al}{U_0 \tau^{1/2}}$$

where l represents a thickness of each of said nonconductive materials, $U_0$ an impulse voltage applied to said nonconductive materials, $\tau$ a time constant, and A a spark constant which is proportional to a sum total of currents flowing when said impulse voltage is applied to said nonconductive materials and a resistance and is inversely proportional to said thickness l; and a liquid provided in container (1), (5) to produce electric discharge while using said liquid or container (1), (5) as ground; and wherein said container (1), (5) includes a bottom plate **(4*a*), (7*a*) having a porous structure through which crushed or smashed nonconductive materials (2) are dropped and an opening and a closing gate (4*b*), (7*b*)** for taking out said crushed or smashed materials is dropped from said bottom plate.

5. A crushing apparatus for nonconductive materials according to claim 4, wherein a plurality of said containers are arranged in a cascade manner and nonconductive material(s) (2) crushed in a first container (1) is successively moved into a container (5) at a next-stage for crushing or smashing again.

* * * * *